US011791591B2

(12) United States Patent
Fong et al.

(10) Patent No.: US 11,791,591 B2
(45) Date of Patent: Oct. 17, 2023

(54) MAGNETIC PLUG

(71) Applicant: Microsoft Technology Licensing, LLC, Redmond, WA (US)

(72) Inventors: Chee Kiong Fong, Saratoga, CA (US); Sujuan Tang, Zhuhai (CN); Leonardo Gilbert Del Castillo, Woodinville, WA (US); Richard F. Johnson, Redmond, WA (US); Edward C. Giaimo, III, Bellevue, WA (US); Thomas K. Mehrkens, Bellevue, WA (US); Kurt David Wrisley, Edmonds, WA (US); Christopher Alan Schafer, Redmond, WA (US); Akash Atul Shah, Boston, MA (US); Mohammed Nadir Haq, Brier, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 174 days.

(21) Appl. No.: 17/309,245

(22) PCT Filed: Dec. 6, 2018

(86) PCT No.: PCT/CN2018/119504
§ 371 (c)(1),
(2) Date: May 11, 2021

(87) PCT Pub. No.: WO2020/113508
PCT Pub. Date: Jun. 11, 2020

(65) Prior Publication Data

US 2021/0399466 A1 Dec. 23, 2021

(51) Int. Cl.

| | |
|---|---|
| ***H01R 13/62*** | (2006.01) |
| ***H01R 13/453*** | (2006.01) |
| ***H01R 43/26*** | (2006.01) |

(52) U.S. Cl.
CPC ..... *H01R 13/6205* (2013.01); *H01R 13/4538* (2013.01); *H01R 43/26* (2013.01)

(58) Field of Classification Search
CPC ..... H01R 13/6205; H01R 13/4538; H01R 13/44; H01R 43/26
See application file for complete search history.

(56) References Cited

U.S. PATENT DOCUMENTS 4,317,969 A * 3/1982 Riegler ..... H01R 13/6205 200/51.09
4,810,202 A * 3/1989 Nodfelt ..... H01R 13/523 439/38

(Continued)

FOREIGN PATENT DOCUMENTS

CN 101273499 A 9/2008
CN 102347550 A 2/2012

(Continued)

OTHER PUBLICATIONS

"Extended European Search Report Issued in Application No. 18942650.5", dated Jun. 21, 2022, 8 Pages.

(Continued)

*Primary Examiner* — Thanh Tam T Le
(74) *Attorney, Agent, or Firm* — Alleman Hall Creasman & Tuttle LLP

(57) ABSTRACT

Examples are disclosed that relate to connector systems, magnetic plug assemblies and methods for mating a magnetic plug assembly with a plurality of receptacles. In one example, a magnetic plug assembly comprises a moveable member comprising an aperture and one or more magnets. A plug tip extends through the aperture, and one or more biasing elements urge the moveable member and the one or more magnets toward a distal end of the plug tip, with the moveable member being moveable relative to the plug tip.

20 Claims, 12 Drawing Sheets

(56) References Cited

U.S. PATENT DOCUMENTS

| | | | | |
|---|---|---|---|---|
| 5,829,987 | A * | 11/1998 | Fritsch | H01R 13/7037 200/51.09 |
| 5,921,783 | A * | 7/1999 | Fritsch | H01R 13/703 439/700 |
| 6,464,509 | B1 * | 10/2002 | Emberty | H01R 13/6205 439/38 |
| 6,966,781 | B1 * | 11/2005 | Bullinger | H01R 13/64 439/38 |
| 7,037,120 | B1 | 5/2006 | Yeh | |
| 7,125,267 | B1 | 10/2006 | Yeh | |
| 7,311,526 | B2 * | 12/2007 | Rohrbach | G06F 1/18 439/39 |
| 7,329,128 | B1 | 2/2008 | Awad | |
| 9,004,930 | B2 * | 4/2015 | Gualino | H01R 13/6205 439/39 |
| 9,431,182 | B2 * | 8/2016 | Kim | H01R 13/7038 |
| 9,614,320 | B2 | 4/2017 | Schooley | |
| 9,893,451 | B2 * | 2/2018 | Zhang | H01R 13/6205 |
| 10,205,279 | B2 * | 2/2019 | Endo | H01R 12/732 |
| 10,348,024 | B2 * | 7/2019 | Yonnet | H01R 13/6205 |
| 10,483,688 | B2 | 11/2019 | Wrisley et al. | |
| 10,522,943 | B1 * | 12/2019 | Termini | H01R 24/38 |
| 10,897,114 | B2 * | 1/2021 | Bombara | H01R 33/88 |
| 11,070,000 | B2 * | 7/2021 | Song | H01R 13/4534 |
| 2007/0072442 | A1 | 3/2007 | Difonzo et al. | |
| 2016/0093975 | A1 | 3/2016 | Katiyar et al. | |
| 2017/0062974 | A1 | 3/2017 | Daoura | |
| 2017/0338578 | A1 | 11/2017 | Zhang et al. | |

FOREIGN PATENT DOCUMENTS

| | | | |
|---|---|---|---|
| CN | 202872122 | U | 4/2013 |
| CN | 204011847 | U | 12/2014 |
| CN | 204349087 | U | 5/2015 |
| CN | 105098451 | A | 11/2015 |
| CN | 107394490 | A | 11/2017 |
| CN | 206806625 | U | 12/2017 |
| WO | 2017175250 | A1 | 10/2017 |

OTHER PUBLICATIONS

"MagNeo: First True USB-C Magnetic Adapter", Retreived From: https://web.archive.org/web/20180909130318/https:/www.kickstarter.com/projects/branchusb/magneo-first-true-usb-c-magnetic-adapter, Sep. 9, 2018, 22 Pages.

"Magnetic Self-Mating Connectors", Retrieved From: https://web.archive.org/web/20191208210112/https://www.rosenberger.com/magnetic-connectors/, Dec. 8, 2019, 3 Pages.

"International Search Report and Written Opinion Issued in PCT Application No. PCT/CN2018/119504", dated Sep. 4, 2019, 11 Pages.

"First Office Action and Search Report Issued in Chinese Patent Application No. 201880100012.8", dated Sep. 2, 2022, 13 Pages.

"Office Action Issued in Indian Patent Application No. 202147024655", dated Jan. 2, 2023, 5 Pages.

"Office Action Issued in Chinese Patent Application No. 201880100012.8", dated Mar. 30, 2023, 6 Pages.

* cited by examiner

MAGNETIC PLUG

CROSS REFERENCE TO RELATED APPLICATIONS

The present application is a U.S. National Phase of International Patent Application Serial No. PCT/CN2018/119504 entitled "MAGNETIC PLUG", filed Dec. 6, 2018, the entire contents of which is hereby incorporated by reference for all purposes.

BACKGROUND

Electronic connectors such as plugs and receptacles are widely used to couple one device to another device or power source. Where the connector and receptacle are relatively small, some users may have difficulty aligning and inserting the plug tip into the receptacle. In situations where the user cannot see the connector, such as when a receptacle is located on the back or side of a device, such difficulties can be increased.

SUMMARY

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

Examples are disclosed that relate to connector systems, magnetic plug assemblies and methods for mating a magnetic plug assembly with a plurality of receptacles. In one example, a magnetic plug assembly comprises a moveable member comprising an aperture and one or more magnets. A plug tip extends through the aperture, and one or more biasing elements urge the moveable member and the one or more magnets toward a distal end of the plug tip, with the moveable member being moveable relative to the plug tip.

DETAILED DESCRIPTION

Figure 1:
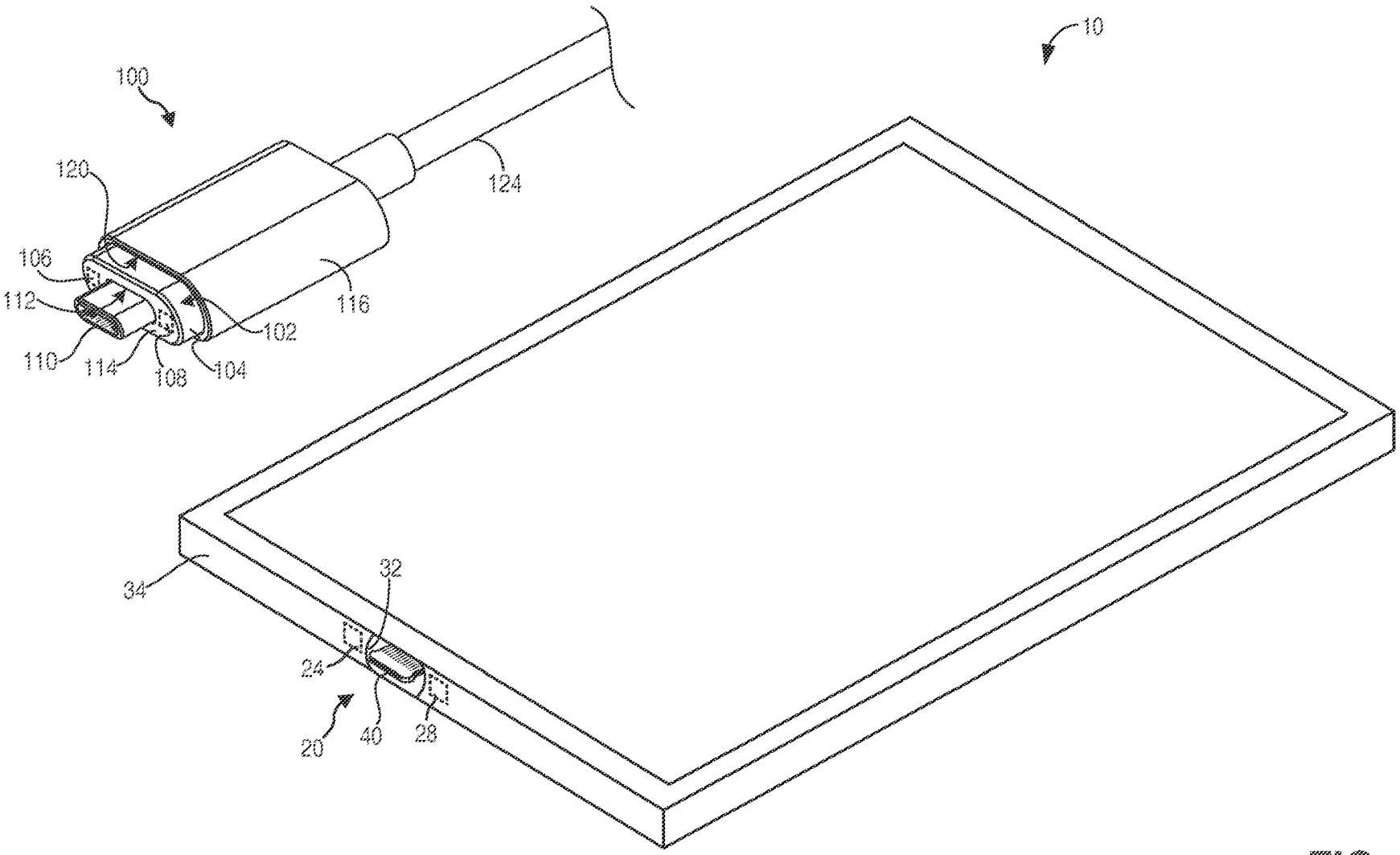
FIG. 1 shows an example of a magnetic plug assembly and magnetic receptacle according to examples of the present disclosure.

As noted above, some users may experience difficulties in mating the plug of an electronic connector with its corresponding receptacle, especially when such components are of a relatively smaller size. Additionally, when the receptacle is located in an inconvenient or awkward location, such as on the rear or side wall of a device, making such a connection can prove particularly challenging.

Some connector plugs may utilize magnets to attract the plug to a corresponding receptacle. Magnetic connection can offer an improved user experience by helping a user to align the plug tip and receptacle. Such connectors also may reduce the insertion force required to seat the plug tip. In some cases magnetic connectors also may protect the user's device from damage when the cable extending from the connector is inadvertently yanked from the device.

However, for some types of connectors the use of such magnetic assistance could be problematic. For example, USB-C is an industry standard that is utilized to provide connectivity options to many consumer electronic products. The standard USB-C plug and receptacle utilize a frictional engagement to attach and detach. Given the length of a standard USB-C receptacle, such a receptacle would require a strong magnetic force to cause the plug tip and receptacle to mate. For example, the inventors of the present disclosure have determined that for a standard USB-C plug and receptacle fitted with magnets, the length of the receptacle would require much greater than 20N of magnetic pull force for the plug tip to mate with the receptacle without user assistance. Additionally, to remove a magnetically seated plug, the user would have to pull the plug with greater than 30N of force, which is much higher than the standard extraction force of 20N specified by the USB-C standard. Such higher required insertion and disconnection forces could result in a poor user experience. Additionally, exerting greater than 30N of force to remove a seated plug could result in damage to the plug, connected cable or both.

Accordingly, the present disclosure describes connector systems, magnetic plug assemblies and receptacles, and related methods that address one or more of the above-described issues. As described in more detail below, the systems and assemblies of the present disclosure enable users to easily and conveniently mate the disclosed magnetic plug assemblies with both magnetic and non-magnetic receptacles with minimal human effort. Additionally, the force required to disconnect the plug assemblies from receptacles is reduced, thereby further improving the user experience and avoiding potential plug/receptacle damage caused by higher extraction forces.

While the following description is provided in relation to a USB-C connector, the features and concepts of the present disclosure also may be utilized with other electronic plugs and receptacles that may have different sizes and/or configurations, and may be associated with different communication and/or power protocols, or with no particular protocol. Examples of other protocols that may be utilized with the plug assemblies and receptacles of the present disclosure may include, but are not limited to, DisplayPort, Thunderbolt, HDMI, USB-A, Mini- and Micro-USB, etc.

Figure 2:
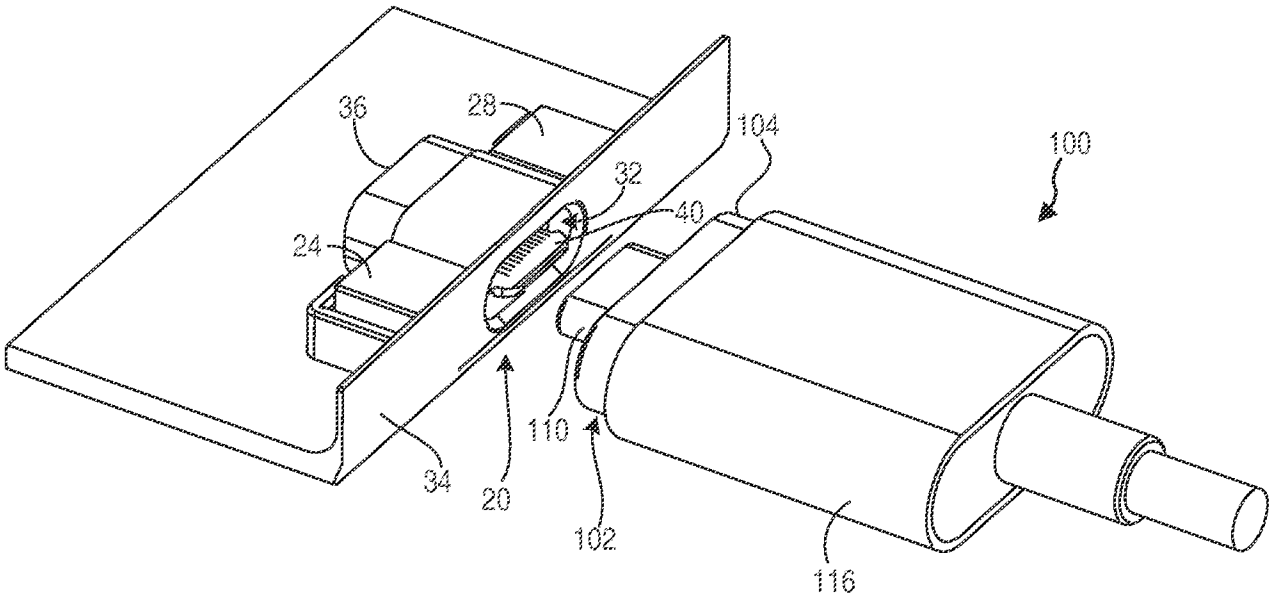
FIG. 2 shows an example of the magnetic plug assembly and a cutaway view of the magnetic receptacle of FIG. 1 according to examples of the present disclosure.
Figure 3:
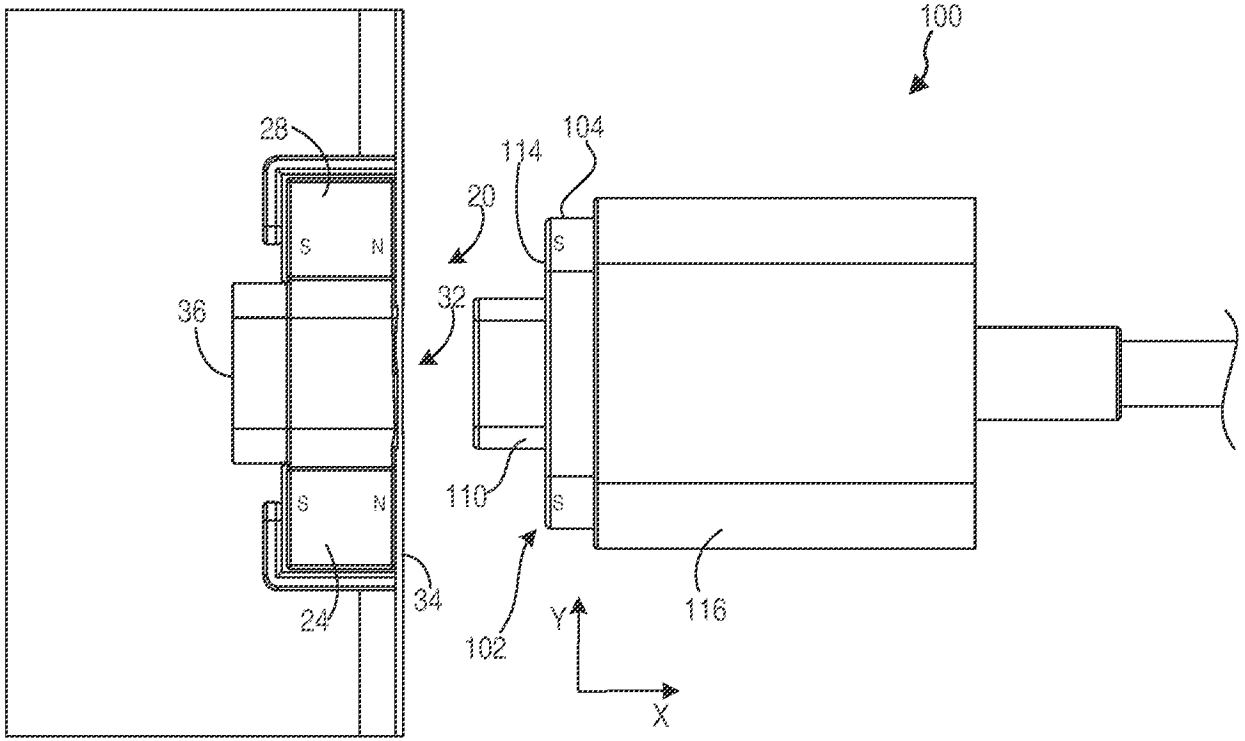
FIG. 3 shows a top view of the magnetic plug assembly and cutaway top view of the magnetic receptacle of FIG. 1 according to examples of the present disclosure.
Figure 4:
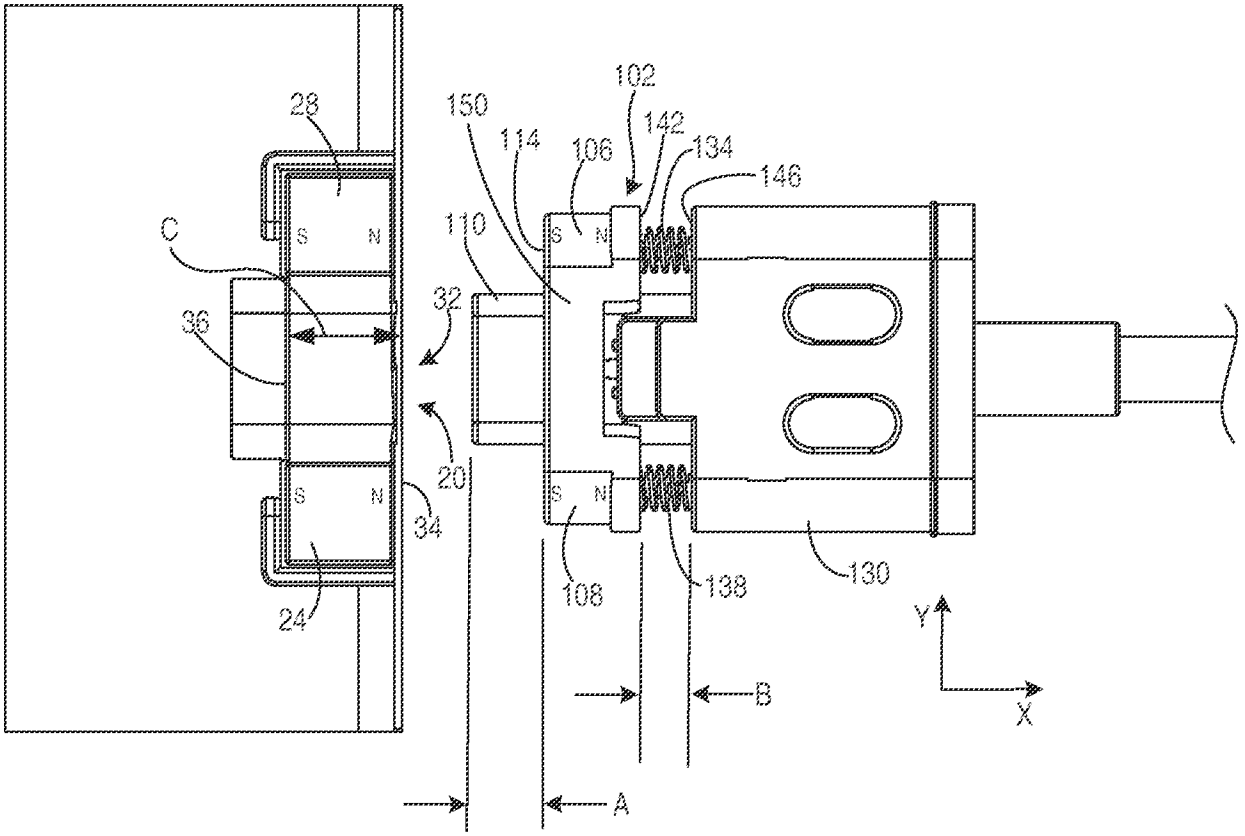
FIG. 4 shows a top view of the magnetic plug assembly of FIG. 3 with housing removed and cutaway top view of the magnetic receptacle according to examples of the present disclosure.
Figure 5:
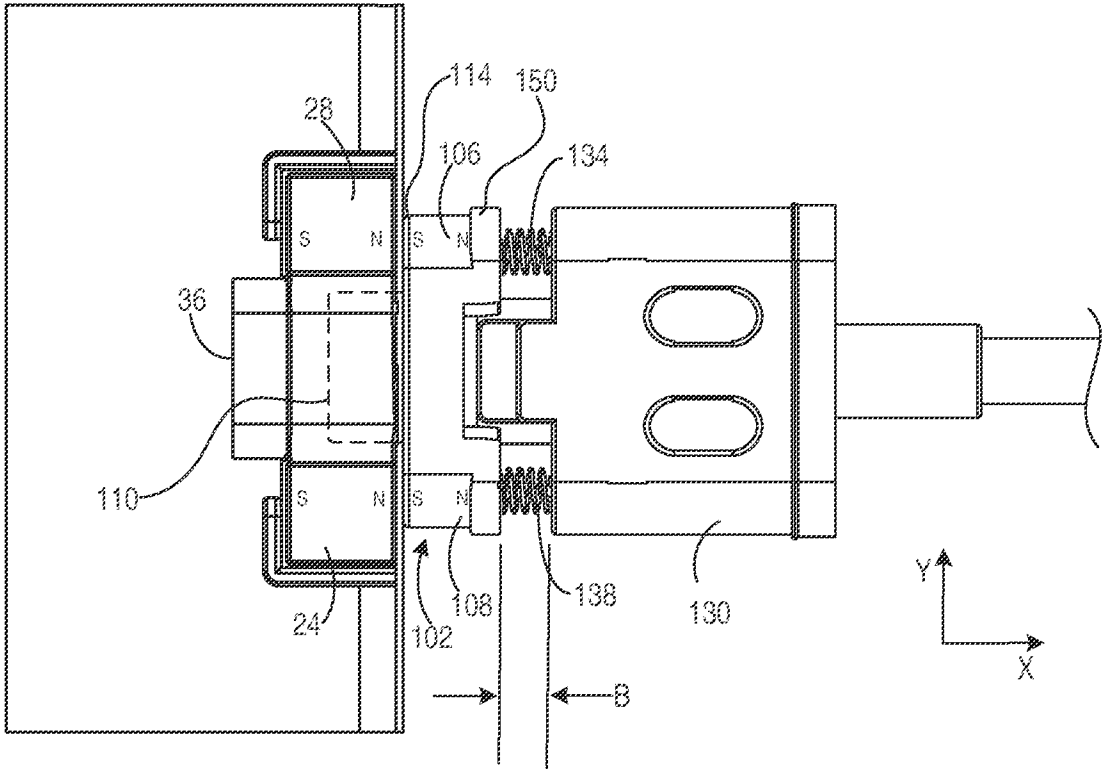
FIG. 5 shows the magnetic plug assembly of FIG. 4 connected to the magnetic receptacle with plug tip seated according to examples of the present disclosure.
Figure 6:
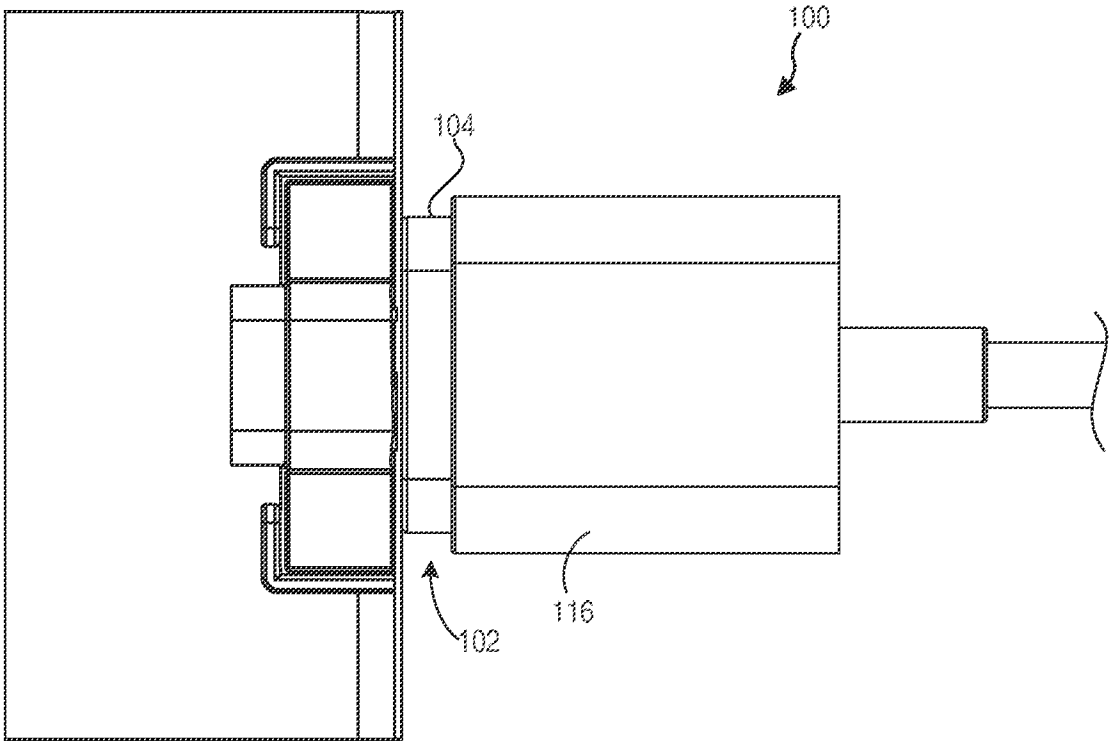
FIG. 6 shows the magnetic plug assembly of FIG. 5 connected to the magnetic receptacle, and shows the housing installed on the plug assembly, according to examples of the present disclosure.

With reference now to FIGS. 1-6, simplified illustrations of a computing device 10 including a magnetic receptacle 20 and a magnetic plug assembly 100 according to an example of the present disclosure are provided. FIG. 1 shows a perspective view of computing device 10 and magnetic plug assembly 100, and FIGS. 2 and 3 show the plug assembly and a partial view of the magnetic receptacle 20 of computing device 10. FIGS. 4 and 5 show views of the magnetic plug assembly 100 with an outer housing 116 removed to reveal biasing elements. As described in more detail below, in some examples the biasing elements enable the magnetic plug assembly 100 to also be utilized with a standard (non-magnetic) receptacle. Similarly, in some examples the magnetic receptacle 20 may be utilized with a standard (non-magnetic) plug. FIG. 6 shows the magnetic plug assembly 100 with outer housing 116 installed and connected to the magnetic receptacle 20

The magnetic receptacle 20 may include one or more receptacle magnets. In the present example, magnetic receptacle 20 includes a first receptacle magnet 24 and a second receptacle magnet 28 on opposing sides of an opening 32. In this example, the receptacle magnets 24, 28 are located behind the bottom wall 34 and internal to the computing device 10, and thus are illustrated in dotted line. In other examples, one or both receptacle magnets 24, 28 may be located above and/or below the opening 32. In other examples, a single, continuous magnet may encircle the opening 32.

As illustrated in this example, the magnetic receptacle 20 may be a USB-C receptacle and the magnetic plug assembly 100 may be a USB-C plug. The magnetic receptacle 20 may include an electronic connector 40. In examples where the magnetic receptacle 20 is a USB-C receptacle, the electronic connector 40 may be a USB-C printed circuit board (PCB) tongue comprising a plurality of receptacle electronic contacts, such as metal contacts. As it will be appreciated, the electronic contacts may engage corresponding plug electronic contacts in the magnetic plug assembly 100 to enable data and/or power communication between the receptacle and the plug assembly.

As described in more detail below, in this example the magnetic plug assembly 100 includes a moveable member 102 that comprises an enclosure 104 in which a first plug magnet 106 and a second plug magnet 108 are located (See also FIG. 4 showing moveable member 102 with the enclosure removed). In this example, the first plug magnet 106 and the second plug magnet 108 are located on opposing sides of a plug tip 110. The plug tip 110 extends through an aperture 112 formed in an end face 114 of the moveable member 102. A plurality of plug electronic contacts are provided inside the plug tip 110. The plug electronic contacts are configured to engage corresponding receptacle contacts as described above when the plug tip is at least partially inserted into the receptacle.

Figure 7:
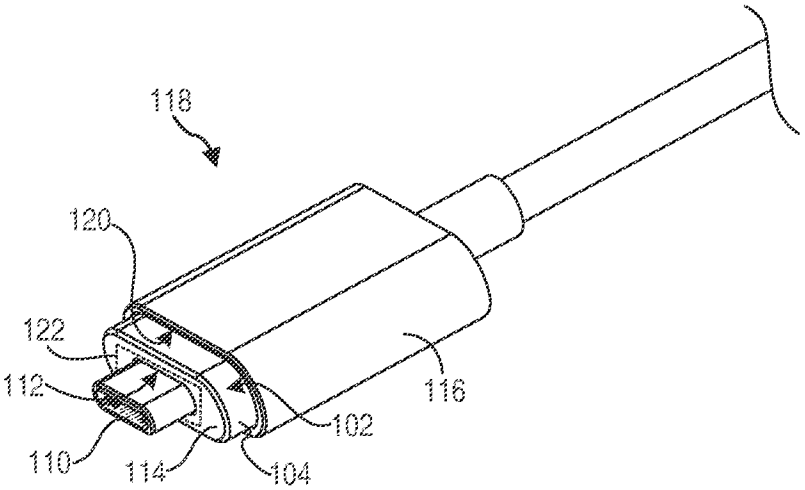
FIG. 7 shows another example of a magnetic plug assembly according to examples of the present disclosure.
Figure 8:
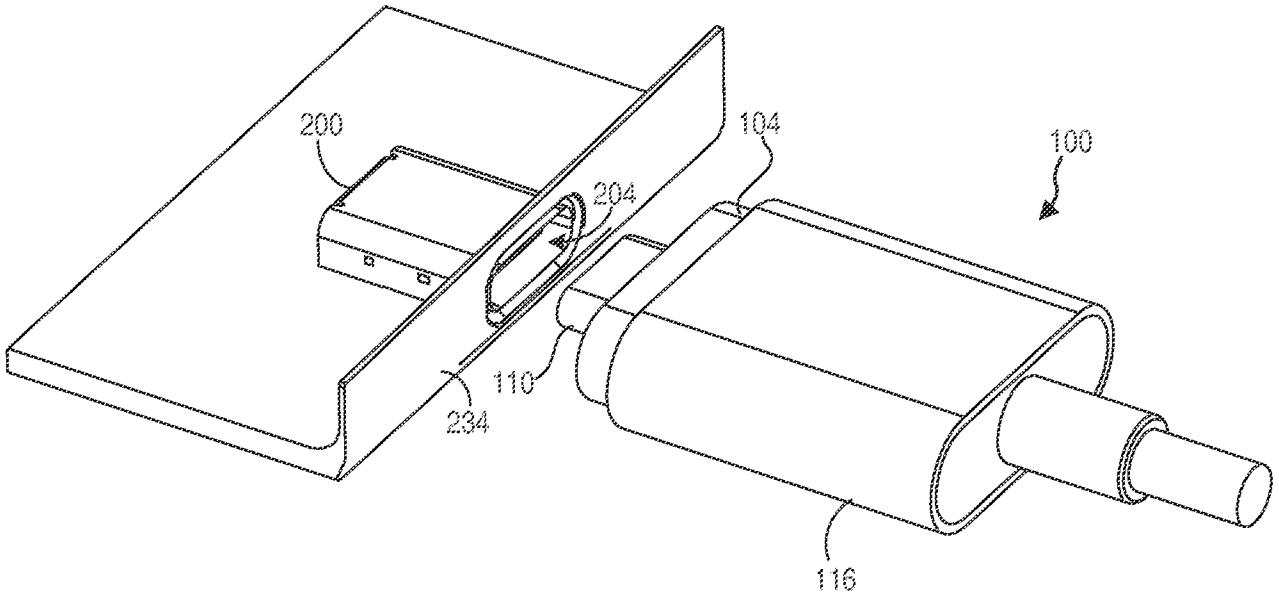
FIG. 8 shows an example of the magnetic plug assembly of FIGS. 1-6 and a cutaway view of a non-magnetic receptacle according to examples of the present disclosure.

In other examples, one or both plug magnets 106, 108 may be located above and/or below the aperture and the plug tip 110. In the present example, the number of receptacle magnets 24, 28 and plug magnets 106, 108 is the same. In other examples of connector systems, the number of receptacle magnets and plug magnets may be different. In another example of a magnetic plug assembly 118, and with reference now to FIG. 7, one or more magnet(s) 122 may encircle the plug tip 110 and aperture 112.

Returning to FIG. 4, the receptacle magnets 24, 28 and/or plug magnets 106, 108 may comprise any suitable type of magnet, such as permanent magnets and/or electromagnets, and may be formed of various magnetic materials. In various examples, the magnetic materials may include rare-earth magnets, such as neodymium ferrite boron (NdFeB), ferromagnetic materials, or other types of magnets. The receptacle magnets 24, 28 and plug magnets 106, 108 may each generate a magnetic force. The magnetic force may be 1.0 Newtons (N), 2.0 N, 4.0 N, 8.0 N, 12.0 N, 24.0 N, or any other suitable value.

As shown in FIGS. 1-3 and 6, the magnetic plug assembly 100 further comprises a housing 116 that includes an opening 120 at a plug tip end of the housing. A cable 124 may extend from a cable end of the housing 116. As described and illustrated in more detail below, the housing 116 encloses a portion of the moveable member 102, such that the moveable member extends through the opening 120 of the housing and is moveable relative to the housing. The housing 116 may enclose one or more electrical and/or mechanical components of the magnetic plug assembly 100.

As described in more detail below, the magnetic plug assembly 100 may be inserted into the magnetic receptacle 20. As illustrated in FIGS. 4 and 5, as the magnetic plug assembly 100 is moved closer to the magnetic receptacle 20, magnetic fields from the plug magnets 106, 108 and the receptacle magnets 24, 28 may pull the magnetic plug assembly toward the magnetic receptacle such that the plug tip 110 is drawn onto and over the electronic connector/tongue 40 and seated within the magnetic receptacle. Inserting the magnetic plug assembly 100 into the magnetic receptacle 20 may comprise aligning the magnetic plug assembly with the receptacle. The orientations of the poles ("N" for North, "S" for South) of the plug magnets 106, 108 and the receptacle magnets 24, 28 are configured to facilitate drawing the magnetic plug assembly 100 and plug tip 110 into the magnetic receptacle 20 and/or aligning the plug assembly with the receptacle. In some examples, such as with USB-C, the magnetic plug assembly 100 may be inserted into the magnetic receptacle in either of two 180 degree orientations. It will be appreciated that the pole orientations shown in FIGS. 3-5 are just one example, and other various orientations may be utilized.

With reference again to FIG. 4, the magnetic receptacle 20 may be shorter than the standard USB-C receptacle. For example, within the opening 32 of the receptacle 20, a distance C from the bottom wall 34 to a rear face 36 of the receptacle may be approximately 6.4 mm. Additionally and as described in more detail below, the moveable member 102 is moveable between an extended position as shown in FIGS. 1-6 (which is its default position) and a retracted position (shown in FIGS. 10 and 11) that enables the magnetic plug assembly 100 to be used with longer receptacles, such as a standard length USB-C receptacle. For example and as described in more detail below, the magnetic plug assembly 100 may comprise one or more biasing elements that urge the moveable member 102 and the plug magnets 106, 108 toward a distal end of the plug tip 110, with the moveable member being moveable relative to the plug tip and to the housing 116 and a base member 130 interior to the housing. In the examples of FIGS. 1-11, the one or more biasing elements comprise a first spring 134 and a second spring 138. In other examples, any suitable form of one or more biasing elements may be utilized, such as one or more elastomeric members.

With reference to FIG. 4, in this example the first spring 134 is positioned adjacent to first plug magnet 106 and the second spring 138 is positioned adjacent to the second plug magnet 138. In other examples, the first spring 134 and/or second spring 138 may be located in other positions relative to the magnets.

With reference to FIGS. 1 and 4 showing the moveable member 102 in the extended position, in this example the plug tip 110 extends from the aperture 112 in the end face 114 of the moveable member by a distance A of approximately 3.9 mm. The first and second springs 134, 138 maintain the moveable member 102 in this extended position, which creates an extended gap B between a rear wall 142 of the moveable member and a shoulder 146 of the base member 130. In this manner, and with reference to FIG. 5, the plug tip 110 may be fully seated within magnetic receptacle 20 when it extends into the receptacle by approximately 3.9 mm, such that the plug electronic contacts mate with the receptacle electronic contacts to electronically couple the plug assembly 100 to the receptacle 20. Additionally and as depicted in FIG. 5, the magnetic receptacle 20 is configured to allow the plug tip 110 to seat inside the magnetic receptacle without causing movement of the moveable member 102 relative to the plug tip. In other words and as shown in FIG. 5, the magnetic plug assembly 100 and the magnetic receptacle 20 are configured to cause the plug tip 110 to seat within the receptacle while the extended gap B remains substantially unchanged.

In this manner, and in one potential advantage of the present disclosure, the shortened length of the magnetic receptacle 20 in combination with the configurations of magnets described above may enable the plug tip 110 to seat within the receptacle with a reduced mating force of approximately 3.5 N. Accordingly and in some examples, when a user moves the plug tip 110 toward the magnetic receptacle 20, the magnets may pull and seat the plug tip 110 within the receptacle without any additional force from the user. In some examples and as described in more detail below, one or more latching features in the plug tip 110 also may cooperate with the length of the receptacle 20 and the magnet configuration to enable the plug tip 110 to seat within the receptacle with a reduced mating force. Similarly and as described below, in some examples a guiding angle and interference dimensions of the electronic connector/tongue 40 of the magnetic receptacle 20 also may be configured to reduce the insertion force as described above.

Additionally, and in another potential advantage of the present disclosure, the shortened length of the magnetic receptacle 20 in combination with the configurations of magnets described above may reduce the disconnect force required to remove the plug tip 110 from the receptacle. In the example of FIGS. 1-6, the disconnect force may be approximately 7.5N. In some examples and as described in more detail below, one or more latching features in the plug tip 110 also may cooperate with the length of the receptacle 20 and the magnet configuration to enable a user to disconnect the plug tip 110 from the receptacle with a reduced disconnect force. Similarly and as described below, in some examples a guiding angle and interference dimensions of the electronic connector/tongue 40 of the magnetic receptacle 20 also may be configured to reduce the required disconnect force.

With reference now to FIGS. 8-11, and in another potential advantage of the present disclosure, the magnetic plug assembly 100 also may be utilized to fully seat the plug tip 110 within other configurations of receptacles. For example and as shown in FIGS. 8-11, the magnetic plug assembly 100 may be utilized with a standard, non-magnetic USB-C receptacle 200. As described in more detail below, the moveable member 104 may enable the plug tip 110 to fully extend into the opening 204 of the receptacle 200 and seat within the longer cavity of the receptacle.

Figure 9:
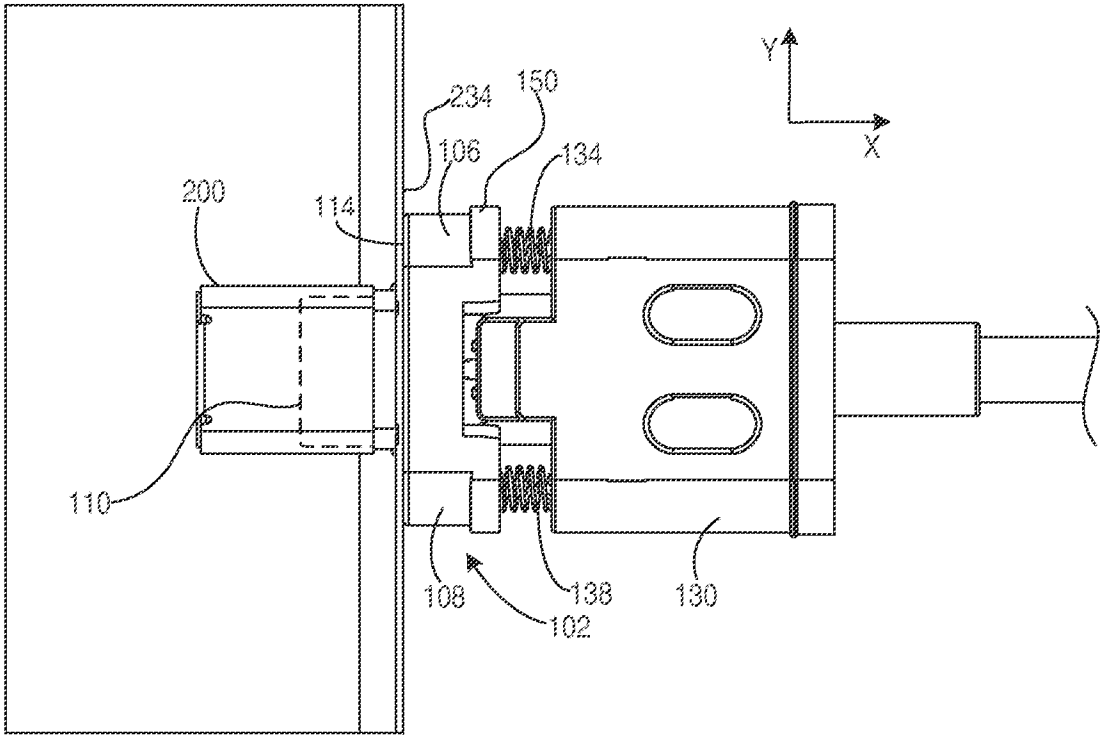
FIG. 9 shows a top view of the magnetic plug assembly with housing removed and cutaway top view of the magnetic receptacle of FIG. 8 with the plug assembly partially inserted into the receptacle according to examples of the present disclosure.
Figure 11:
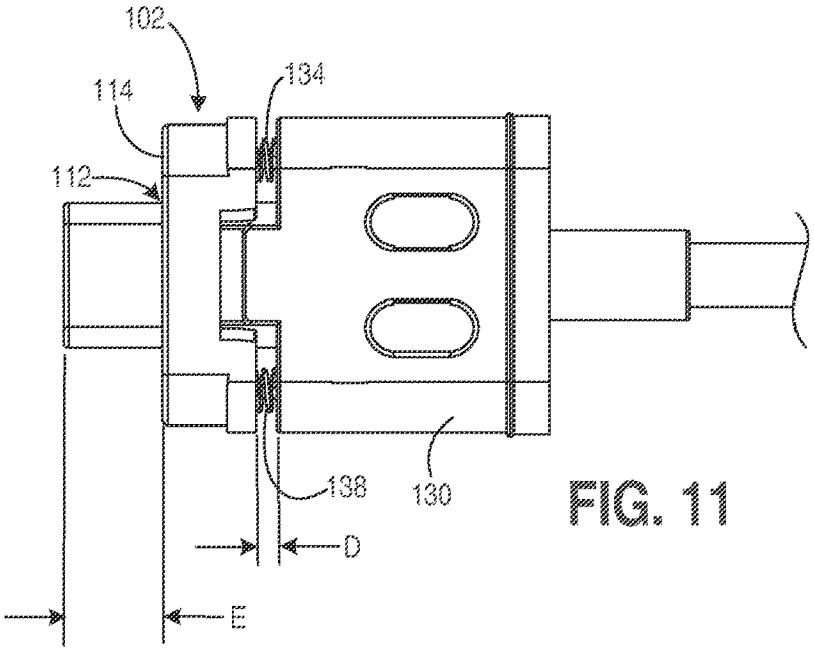
FIG. 11 shows the magnetic plug assembly of FIG. 10 with the moveable housing in the retracted position.
Figure 10:
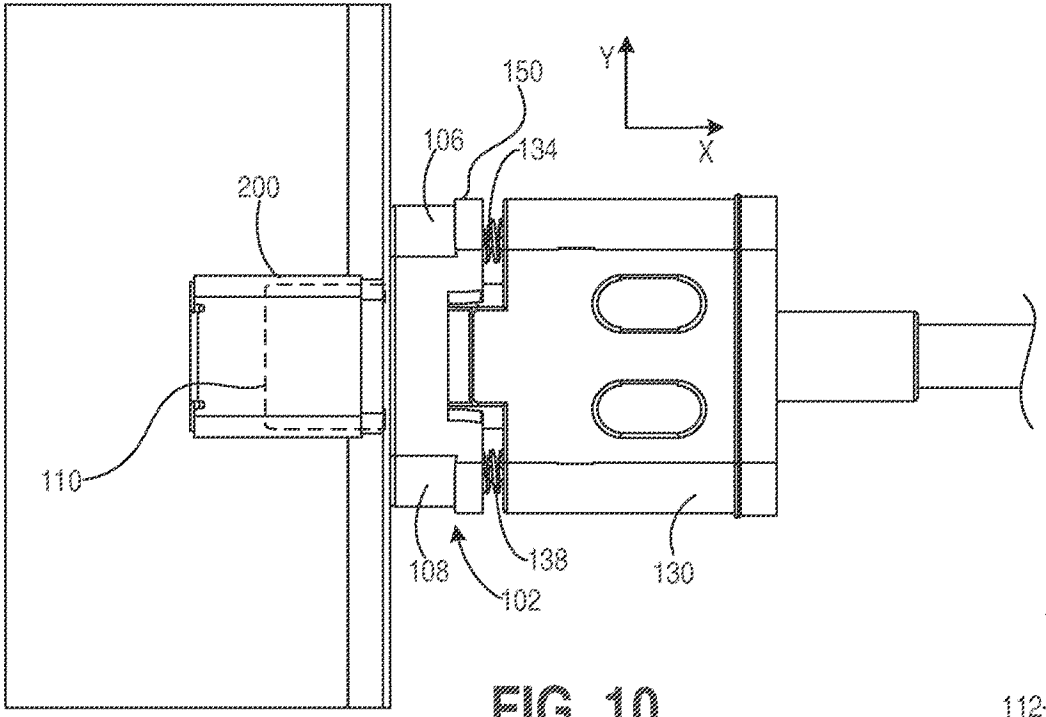
FIG. 10 shows a top view of the magnetic plug assembly with housing removed and cutaway top view of the magnetic receptacle of FIG. 8 with the plug assembly fully inserted and seated in the receptacle according to examples of the present disclosure.

With reference now to FIG. 9, a user may partially insert the plug tip 110 into the opening 204 until the end face 114 of the moveable member 102 contacts a wall 234 of the computing device in which the receptacle 200 is installed. In this position, the moveable member is in the extended position as described above, but the electronic contacts of the plug tip may not be engaging the corresponding contacts in the receptacle 200. Accordingly and as shown in FIGS. 10 and 11, the user may then push the moveable member in the −X axis direction to further insert the plug tip 110 into the receptacle 200 and cause the electronic contacts of the plug tip to engage the corresponding contacts of the receptacle, and to seat the plug tip in the receptacle. In this manner, the plug tip 110 moves in the X-axis direction relative to the body 150 of the moveable member 102, such that the plug tip extends further outwardly from the aperture 112 in the end face 114 of the moveable member.

FIG. 11 provides an illustration of the magnetic plug assembly 100 with the moveable member 102 in the retracted position. As best seen in this figure and FIG. 10, when the plug tip 110 is seated within receptacle 200, the moveable member 102 is in a retracted position relative to the base member 130 of the magnetic plug assembly. In this example, in this retracted position the plug tip 110 extends from the aperture of the moveable member by a longer distance E of approximately 5.6 mm. In this retracted position, first spring 134 and a second spring 138 are compressed and create a smaller gap D between rear wall 142 of the moveable member and shoulder 146 of the base member 130. In this example the gap D may be approximately 4.0 mm.

Accordingly, and in another potential advantage of the present disclosure, the magnetic plug assembly 100 also may be utilized with other magnetic and non-magnetic receptacles having contacts located deeper into the receptacle, such as standard USB-C receptacles.

Figure 12:
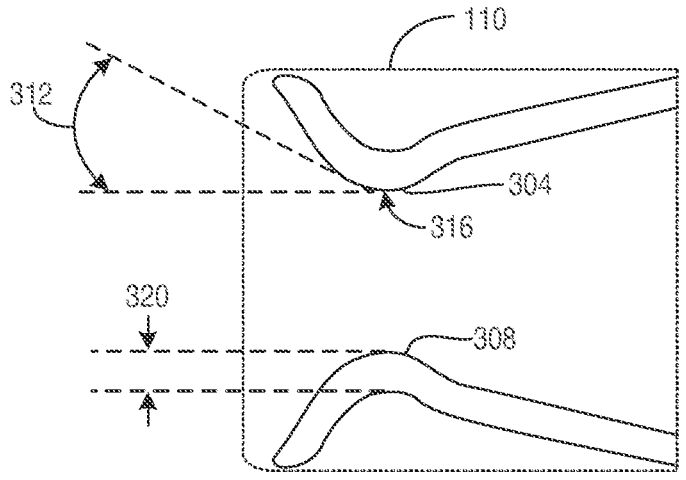
FIG. 12 shows a pair of plug contacts according to an example of the present disclosure.

FIG. 12 illustrates one example of a plug contact configuration that may be utilized within the plug tip 110 to further enable the plug tip to easily seat within a receptacle and be easily disconnected and removed from the receptacle. In this example, a first plug contact 304 and opposing second plug contact 308 are shown. Each plug contact is configured to have an insertion guiding angle 312 of between approximately 33 degrees and 37 degrees. In one example the insertion guiding angle may be approximately 35 degrees. Each plug contact also may have a radius 316 of between approximately 0.55 and 0.65. In one example the radius may be approximately 0.60 degrees. Each plug contact also may have an interference dimension 320 of between approximately 0.21 mm and 0.17 mm. In one example the interference dimension may be approximately 0.19 mm. In this manner, and using one or more of these plug contact dimensions, the plug tip may be easily seated within a receptacle and also may be easily disconnected and removed from the receptacle.

Figure 13:
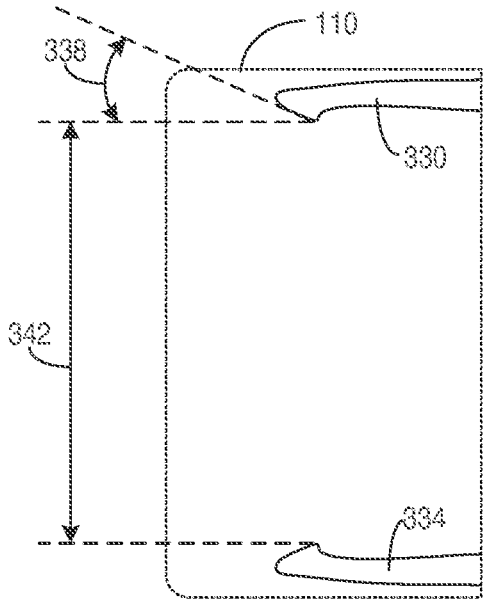
FIG. 13 shows latch mechanism for a plug tip according to an example of the present disclosure.

With reference now to FIG. 13, one example of a latch mechanism is illustrated that may be utilized inside the plug tip 110 to further enable the plug tip to easily seat within a receptacle and be easily disconnected and removed from the receptacle. The latch mechanism may cooperate with a corresponding electronic connector, such as PCB tongue 350 shown in FIG. 14, of a receptacle to create an interference between the plug tip and the receptacle that needs to be overcome during attachment and detachment of the two parts. In this example, a first latch 330 and opposing second latch 334 are shown. Each latch is configured to have an insertion guiding angle 338 of between approximately 28 degrees and 32 degrees. In one example the insertion guiding angle 338 may be approximately 30 degrees. The latches 330 and 334 also may be configured to create an interference dimension 342 of between approximately 6.18 mm and 6.26 mm. In one example the interference dimension 342 may be approximately 6.20. In this manner, and using one or more of these latch configurations, the plug tip may be easily and securely seated within a receptacle, and also may be easily disconnected and removed from the receptacle.

Figure 14:
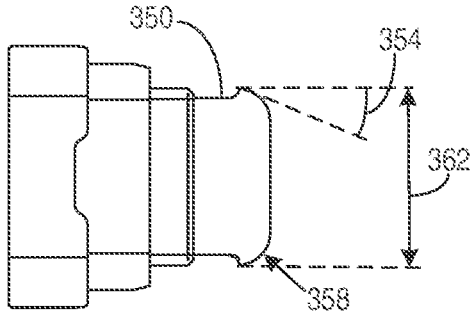
FIG. 14 shows a tongue for a receptacle according to examples of the present disclosure.

In a similar manner and with reference now to FIG. 14, one example of a PCB tongue 350 for a receptacle is illustrated that may be utilized with a latch mechanism as described herein. In this example a guiding angle, radius and interference dimensions of the tongue are configured cooperate with a latch mechanism of a plug tip to enable a user to easily and securely seat the plug tip within the receptacle, while also enabling easy disconnection and removal from the receptacle. In this example, a guiding angle 354 of the tongue 350 may be between approximately 19.8 degrees and 23.8 degrees. In one example the guiding angle may be approximately 21.8 degrees. The tongue 350 also may have a radius 358 of approximately 2.40. The tongue 350 also may have an interference dimension 362 of between approximately 6.55 mm and 6.65 mm. In one example the interference dimension 362 may be approximately 6.60 mm. In this manner, and using one or more of these tongue configurations, a plug tip may be easily and securely seat over the tongue, and also may be easily disconnected and removed from the receptacle.

Figure 15:
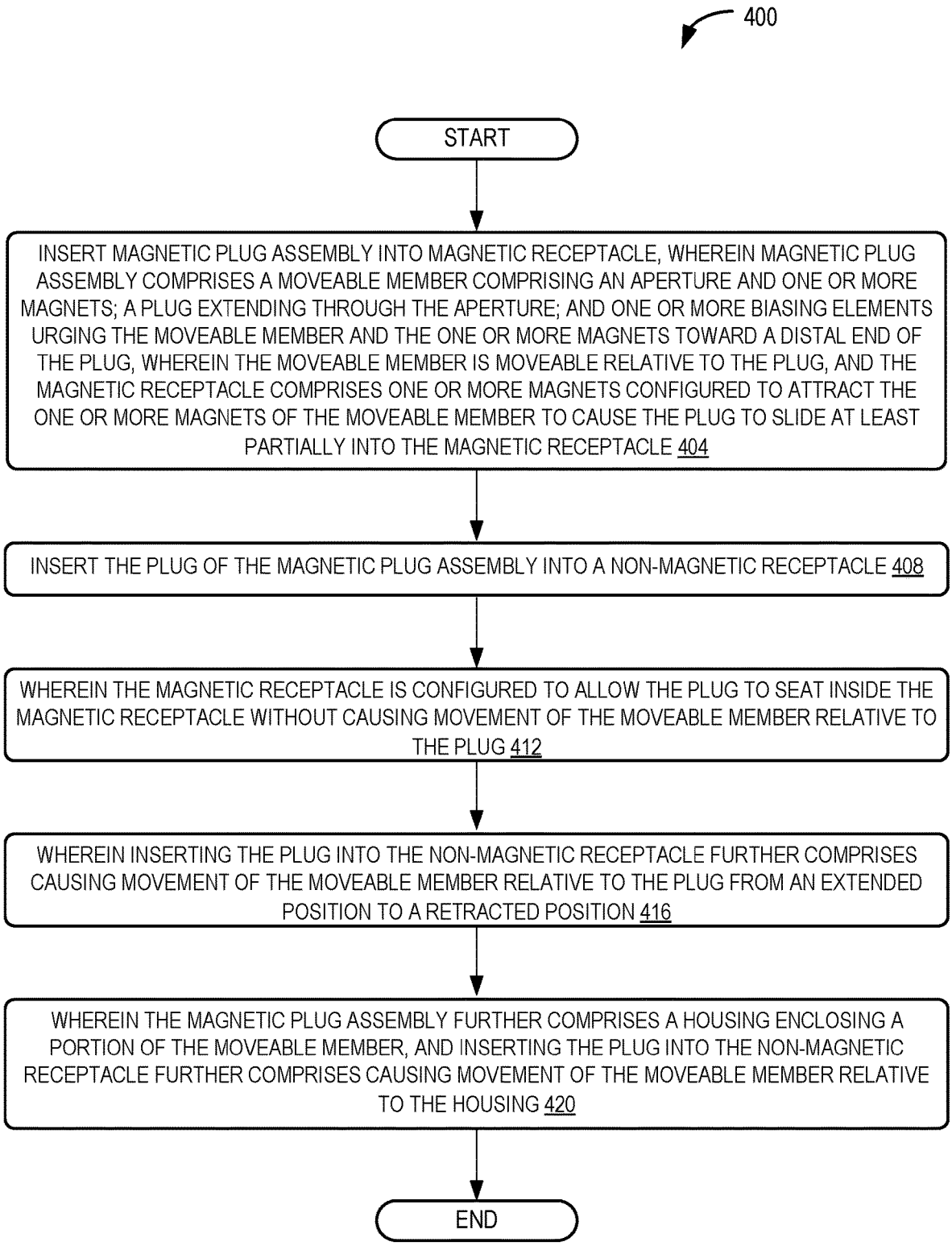
FIG. 15 is a block diagram of a method for mating a magnetic plug assembly with a plurality of receptacles according to examples of the present disclosure.

With reference now to FIG. 15, an example of a method 400 for mating a magnetic plug assembly with a plurality of receptacles is provided. The following description of method 400 is provided with reference to the components described herein and shown in FIGS. 1-14. It will be appreciated that method 400 also may be performed in other contexts using other suitable hardware and software components.

With reference to FIG. 15, at 404 the method 400 may include inserting the magnetic plug assembly into a magnetic receptacle, wherein the magnetic plug assembly comprises a moveable member comprising an aperture and one or more magnets; a plug tip extending through the aperture; and one or more biasing elements urging the moveable member and the one or more magnets toward a distal end of the plug tip, wherein the moveable member is moveable relative to the plug tip; and the magnetic receptacle comprises one or more magnets configured to attract the one or more magnets of the moveable member to cause the plug tip to slide at least partially into the magnetic receptacle. At 408 the method 400 may include inserting the plug tip of the magnetic plug tip assembly into a non-magnetic receptacle.

At 412 the method 400 may include wherein the magnetic receptacle is configured to allow the plug tip to seat inside the magnetic receptacle without causing movement of the moveable member relative to the plug tip. At 416 the method 400 may include, wherein inserting the plug tip into the non-magnetic receptacle further comprises causing movement of the moveable member relative to the plug tip from an extended position to a retracted position. At 420 the method 400 may include, wherein the magnetic plug assembly further comprises a housing enclosing a portion of the moveable member, and inserting the plug tip into the non-magnetic receptacle further comprises causing movement of the moveable member relative to the housing.

The following paragraphs provide additional support for the claims of the subject application. One aspect provides a magnetic plug assembly, comprising a moveable member comprising an aperture and one or more magnets; a plug tip extending through the aperture; and one or more biasing elements urging the moveable member and the one or more magnets toward a distal end of the plug tip, wherein the moveable member is moveable relative to the plug tip. The magnetic plug may additionally or alternatively include, a housing enclosing a portion of the moveable member, wherein the housing comprises an opening at a plug tip end through which the moveable member extends. The magnetic plug may additionally or alternatively include, wherein the moveable member is also moveable relative to the housing. The magnetic plug may additionally or alternatively include, wherein the moveable member comprises 2 magnets located on opposing sides of the aperture. The magnetic plug may additionally or alternatively include, wherein a first biasing element is positioned adjacent to a first magnet of the 2 magnets, and a second biasing element is positioned adjacent to a second magnet of the 2 magnets. The magnetic plug may additionally or alternatively include, wherein the moveable member comprises a magnet encircling the aperture. The magnetic plug may additionally or alternatively include, wherein the moveable member is moveable between an extended position and a retracted position, and the plug tip extends from the aperture of the moveable member by approximately 3.9 mm. when the moveable member is in the extended position. The magnetic plug may additionally or alternatively include, wherein the plug tip extends from the aperture of the moveable member by approximately 5.6 mm. when the moveable member is in the retracted position.

Another aspect provides a connector system comprising a magnetic plug assembly, with the magnetic plug assembly comprising a moveable member comprising an aperture and one or more magnets; a plug tip extending through the aperture; and one or more biasing elements urging the moveable member and the one or more magnets toward a distal end of the plug tip, wherein the moveable member is moveable relative to the plug tip; and a magnetic receptacle comprising one or more magnets configured to attract the one or more magnets of the moveable member to at least partially cause the plug tip to slide into the magnetic receptacle. The connector system may additionally or alternatively include, wherein the magnetic plug assembly further comprises a housing enclosing a portion of the moveable member, wherein the housing comprises an opening at a plug tip end through which the moveable member extends. The connector system may additionally or alternatively include, wherein the moveable member is moveable relative to the housing. The connector system may additionally or alternatively include, wherein the moveable member comprises 2 magnets located on opposing sides of the aperture. The connector system may additionally or alternatively include, wherein a first biasing element is positioned adjacent to a first magnet of the 2 magnets, and a second biasing element is positioned adjacent to a second magnet of the 2 magnets. The connector system may additionally or alternatively include, wherein the moveable member comprises a magnet encircling the aperture. The connector system may additionally or alternatively include, wherein the moveable member is moveable between an extended position and a retracted position, and the plug tip extends from the aperture of the moveable member by approximately 3.9 mm. when the moveable member is in the extended position. The connector system may additionally or alternatively include, wherein the plug tip extends from the aperture of the moveable member by approximately 5.6 mm. when the moveable member is in the retracted position.

Another aspect provides a method for mating a magnetic plug assembly with a plurality of receptacles, the method comprising: inserting the magnetic plug assembly into a magnetic receptacle, wherein the magnetic plug assembly comprises: a moveable member comprising an aperture and one or more magnets; a plug tip extending through the aperture; and one or more biasing elements urging the moveable member and the one or more magnets toward a distal end of the plug tip, wherein the moveable member is moveable relative to the plug tip, and the magnetic receptacle comprises one or more magnets configured to attract the one or more magnets of the moveable member to cause the plug tip to slide at least partially into the magnetic receptacle; and inserting the plug tip of the magnetic plug assembly into a non-magnetic receptacle. The method may additionally or alternatively include, wherein the magnetic receptacle is configured to allow the plug tip to seat inside the magnetic receptacle without causing movement of the moveable member relative to the plug tip. The method may additionally or alternatively include, wherein inserting the plug tip into the non-magnetic receptacle further comprises causing movement of the moveable member relative to the plug tip from an extended position to a retracted position. The method may additionally or alternatively include, wherein the magnetic plug assembly further comprises a housing enclosing a portion of the moveable member, and inserting the plug tip into the non-magnetic receptacle further comprises causing movement of the moveable member relative to the housing.

It will be understood that the configurations and/or approaches described herein are exemplary in nature, and that these specific embodiments or examples are not to be considered in a limiting sense, because numerous variations are possible. The specific routines or methods described herein may represent one or more of any number of processing strategies. As such, various acts illustrated and/or described may be performed in the sequence illustrated and/or described, in other sequences, in parallel, or omitted. Likewise, the order of the above-described processes may be changed.

The subject matter of the present disclosure includes all novel and non-obvious combinations and sub-combinations of the various processes, systems and configurations, and other features, functions, acts, and/or properties disclosed herein, as well as any and all equivalents thereof.

The invention claimed is:

1. A magnetic plug assembly, comprising:

a moveable member comprising an aperture and one or more magnets;

a plug tip extending through the aperture, the plug tip comprising a plurality of electronic contacts on a printed circuit board; and one or more biasing elements urging the moveable member and the one or more magnets toward a distal end of the plug tip, wherein the moveable member is moveable relative to the plug tip.

2. The magnetic plug assembly of claim 1, further comprising a housing enclosing a portion of the moveable member, wherein the housing comprises an opening at a plug tip end through which the moveable member extends.

3. The magnetic plug assembly of claim 2, wherein the moveable member is also moveable relative to the housing.

4. The magnetic plug assembly of claim 1, wherein the one or more magnets of the moveable member comprises 2 magnets located on opposing sides of the aperture.

5. The magnetic plug assembly of claim 4, wherein a first biasing element is positioned adjacent to a first magnet of the 2 magnets, and a second biasing element is positioned adjacent to a second magnet of the 2 magnets.

6. The magnetic plug assembly of claim 1, wherein the moveable member comprises a magnet encircling the aperture.

7. The magnetic plug assembly of claim 1, wherein the moveable member is moveable between an extended position and a retracted position, and the plug tip extends from the aperture of the moveable member by approximately 3.9 mm. when the moveable member is in the extended position.

8. The magnetic plug assembly of claim 7, wherein the plug tip extends from the aperture of the moveable member by approximately 5.6 mm. when the moveable member is in the retracted position.

9. A connector system, comprising:

a magnetic plug assembly, comprising:

a moveable member comprising an aperture and one or more magnets;

a plug tip extending through the aperture, the plug tip comprising a plurality of electronic contacts on a printed circuit board; and one or more biasing elements urging the moveable member and the one or more magnets toward a distal end of the plug tip, wherein the moveable member is moveable relative to the plug tip; and a magnetic receptacle comprising one or more magnets configured to attract the one or more magnets of the moveable member to at least partially cause the plug tip to slide into the magnetic receptacle.

10. The connector system of claim 9, wherein the magnetic plug assembly further comprises a housing enclosing a portion of the moveable member, wherein the housing comprises an opening at a plug tip end through which the moveable member extends.

11. The connector system of claim 10, wherein the moveable member is moveable relative to the housing.

12. The connector system of claim 9, wherein the one or more magnets of the moveable member comprises 2 magnets located on opposing sides of the aperture.

13. The connector system of claim 12, wherein a first biasing element is positioned adjacent to a first magnet of the 2 magnets, and a second biasing element is positioned adjacent to a second magnet of the 2 magnets.

14. The connector system of claim 9, wherein the moveable member comprises a magnet encircling the aperture.

15. The connector system of claim 9, wherein the moveable member is moveable between an extended position and a retracted position, and the plug tip extends from the aperture of the moveable member by approximately 3.9 mm. when the moveable member is in the extended position.

16. The connector system of claim 15, wherein the plug tip extends from the aperture of the moveable member by approximately 5.6 mm. when the moveable member is in the retracted position.

17. A method for mating a magnetic plug assembly with a plurality of receptacles, the method comprising:

inserting the magnetic plug assembly into a magnetic receptacle, wherein the magnetic plug assembly comprises:

a moveable member comprising an aperture and one or more magnets;

a plug tip extending through the aperture, the plug tip comprising a plurality of electronic contacts on a printed circuit board; and one or more biasing elements urging the moveable member and the one or more magnets toward a distal end of the plug tip, wherein the moveable member is moveable relative to the plug tip, and the magnetic receptacle comprises one or more magnets configured to attract the one or more magnets of the moveable member to cause the plug tip to slide at least partially into the magnetic receptacle; and inserting the plug tip of the magnetic plug assembly into a non-magnetic receptacle.

18. The method of claim 17, wherein the magnetic receptacle is configured to allow the plug tip to seat inside the magnetic receptacle without causing movement of the moveable member relative to the plug tip.

19. The method of claim 17, wherein inserting the plug tip into the non-magnetic receptacle further comprises causing movement of the moveable member relative to the plug tip from an extended position to a retracted position.

20. The method of claim 17, wherein the magnetic plug assembly further comprises a housing enclosing a portion of the moveable member, and inserting the plug tip into the non-magnetic receptacle further comprises causing movement of the moveable member relative to the housing.

* * * * *